United States Patent [19]

Prichard

[11] Patent Number: 4,508,956

[45] Date of Patent: Apr. 2, 1985

[54] HEAT DEVICE FOR HEATING PORTIONS OF SHOE UPPERS

[75] Inventor: Arthur W. Prichard, Leicester, England

[73] Assignee: USM Corporation, Farmington, Conn.

[21] Appl. No.: 412,994

[22] Filed: Aug. 30, 1982

[30] Foreign Application Priority Data

Sep. 12, 1981 [GB] United Kingdom ..... 8127602

[51] Int. Cl.[3] ..... A43D 25/20; H05B 1/02

[52] U.S. Cl. ..... 219/215; 12/54.1

[58] Field of Search ..... 219/215, 251, 358, 516; 12/54.1, 54.3

[56] References Cited

U.S. PATENT DOCUMENTS 3,418,449 12/1968 Cleversly ..... 219/215

4,284,874 8/1981 Prichard ..... 219/251

FOREIGN PATENT DOCUMENTS 650289 10/1962 Canada ..... 219/215

1186875 4/1970 United Kingdom ..... 219/215

*Primary Examiner*—Werner H. Schroeder

*Assistant Examiner*—Steven N. Meyers

*Attorney, Agent, or Firm*—Donald N. Halgren

[57] ABSTRACT

A clamp-type heater for heating shoe upper portions prior to molding them comprises an inner metal form (18) and a co-operating outer band (26) of silicone rubber material. The form (18) is heated e.g. by a cartridge heater while the band (26) is heated by a radiant heater (36) arranged about its outer surface. When the inner form (18) carries a shoe upper portion into the band (26), the latter wraps round the portion and clamps it about the form to ensure efficient heat transfer. The temperature of the outer band (26) is sensed by a thermistor (46) which is accommodated in a tube (48) secured by adhesive to the outer surface of the outer band. More particularly, the tube (48) is secured to the band (26) by a line contact and its longitudinal axis extends perpendicular to the direction in which the band is stretched during the operation of the device. The thermistor (46) co-operates with an electronic controller (56) to maintain the band at the control temperature set, without any wide fluctuations which are characteristic of e.g. thermostatic control means. The tube (48) is of a silicone rubber material having similar heat-conductive properties to those of the band (26).

3 Claims, 2 Drawing Figures

HEAT DEVICE FOR HEATING PORTIONS OF SHOE UPPERS

BACKGROUND OF THE INVENTION (1) Field of the Invention

This invention is concerned with improvements in or relating to a heater device for heating portions of shoe uppers prior to molding such uppers to a desired shape.

(2) Prior Art

A heater device described in our U.K. Pat. No. 39373/78 U.S. Pat. No. 4,284,874 has the temperature sensing element and controller which constitute a thermostatic control means, the sensing element being arranged so as to sense changes in temperature of the air in a chamber in which the inner form and outer band are accommodated. Furthermore, in the operation of said device, the second heating means is rendered operative, regardless of the thermostatic control member, whenever the device is operated to heat a shoe upper. Thus, the thermostatic control means is rather intended to ensure that, when the device is not in use but is nevertheless switched on, over-heating of the outer band, and thus its consequent degradation, can be avoided.

In using said device, satisfactory heating has readily been achieved with ladies' and children's shoe uppers. With men's shoes, on the other hand, because in use the time allocated to conditioning the upper in the heater device is restricted, and bearing in mind the greater heat drain from the band by the upper, which is of course of greater area, the output of the second heating means has to be significantly higher than in the case of ladies' and children's work. With heating means of larger output, however, the danger again arises of causing the band to degrade by excess heating, and the thermostatic control means, which essentially was used to enable the heater device to be left for relatively short break periods in a working shift, rather than for controlling the maximum temperature of the band, has proved insufficient therefore for protecting the band against excess heat in such circumstances. This of course arose essentially because of the wide fluctuations allowed by the thermostatic control means at either side of the control temperature set.

In sensing the temperature of the band, however, as opposed to the air within the chamber of the heater device difficulties have been found in attaching any temperature sensing element to the outer band without causing damage to the band and or the temperature sensing element without causing damage to the band when stretching occurs. In this regard, it will of course be appreciated that the silicone rubber sheet material of which the outer band is made has good stretch properties but relatively low cut growth resistance. Thus, it has been found that any cut or incision made in the material is likely to initiate tearing under stretch conditions, and further any attachment which causes the stretch properties to be varied in a localized area is likely to lead to tear in the region of the boundary between such area and the remainder of the band.

It is thus the object of the present invention to provide a heater device of the type aforementioned, wherein the temperature of the band is sensed by a temperature sensing element attached or secured thereto, but without the stretch properties of the material of the band being significantly varied and without running the risk of tearing of the band.

BRIEF SUMMARY OF THE INVENTION

The invention comprises a shaped inner form, a cooperating outer band of a flexible silicone rubber sheet material, and means for effecting relative movement between the inner form and the outer band, whereby a shoe upper placed therebetween can be clamped between the inner form and the outer band, the latter stretching about the inner form to cause the upper to be conformed to the shape thereof, and thus causing the shoe upper to be pressed over its area against the inner form the device also comprising first and second heating means for heating respectively the inner form and the outer band, the second heating means comprising radiant heater means to which the outer surface of the band is exposed, and temperature control means for controlling the operation of the second heating means, said temperature control means comprising a temperature sensing element and a controller operable in response to signals from said element to render the second heating means operative or inoperative. The temperature sensing element is carried in a pocket constituted by a portion of flexible silicone rubber material having a tubular cross-section, said portion being secured by adhesive, with a line contact, to the outer band, with its longitudinal axis perpendicular to the direction of stretch of the outer band.

In this way, because of the line contact only, no significant effect is created on the stretch properties of the material along the direction of stretch. Furthermore, because of the line contact, the portion of tubular cross-section is not significantly deformed during the stretching of the outer band, so that the risk of damage to the temperature sensing element, which may be of a delicate construction, is minimized. Again, by providing a pocket for the temperature sensing element, such element can be withdrawn when the outer band is to be replaced and can be used in the replacement band.

Because of the relatively poor heat-conducting properties of silicone rubber, ideally the temperature sensing element should be secured on the inner surface of the band, that is to say the surface which engages the shoe upper. However, since any protrusion on said surface could prove detrimental to the upper engaged thereby, preferably, and in accordance with a further feature of the invention, the portion constituting the pocket is secured as aforesaid to the outer surface of the band. In addition, because conventionally inner forms of different sizes are used according to the work being conditioned, and the outer band is intended for use with forms of different sizes, conveniently the portion constituting the pocket is located in a central region of the outer surface of the band, which region will always engage an upper regardless of the size of the inner form.

The portion constituting the pocket may be of any desired cross-section which is tubular; in a preferred embodiment it is of circular cross-section.

The temperature sensing element is preferably of the thermocouple type and in a preferred embodiment is constituted by a thermistor.

BRIEF DESCRIPTION OF THE DRAWINGS

There now follows a detailed description, to be read with reference to the accompanying drawings, of one heater device in accordance with the invention, hereinafter called the "illustrative device". It will be appreciated that this illustrative device has been selected for description merely for exemplification of the invention and not by way of limitation thereof.

In the accompanying drawings.

DESCRIPTION OF THE PREFERRED EMBODIMENT

Figure 1:
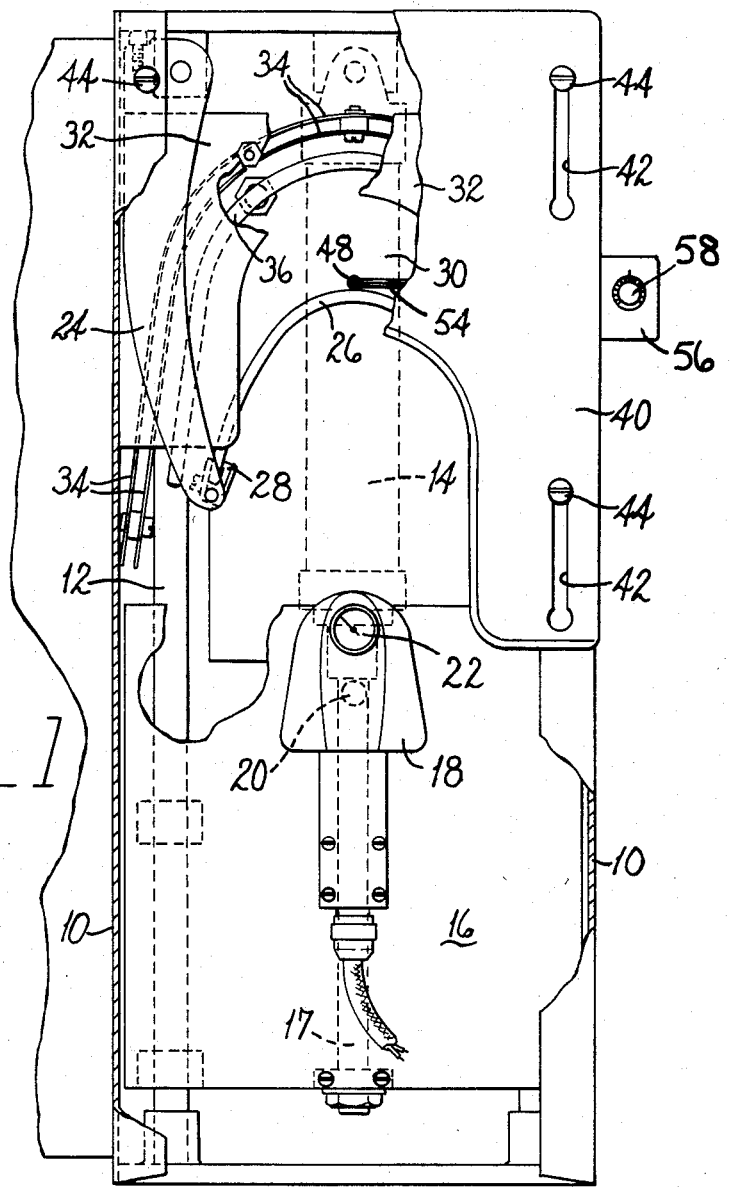
FIG. 1 is a front view with parts broken away, of the illustrative device.
Figure 2:
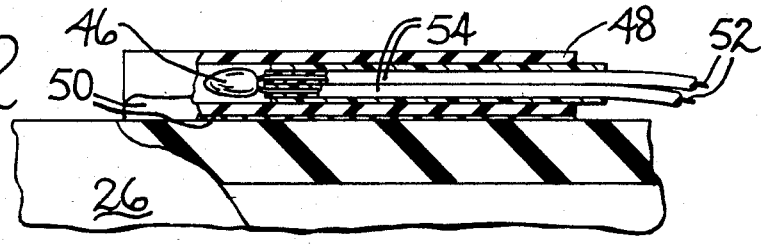
FIG. 2 is a section view showing details of a pocket secured to an outer band of the illustrative device and accommodating a temperature sensing element.

The illustrative device, which is suitable for use in heating backpart portions of shoe uppers prior to the backpart molding of such uppers, comprises a frame 10 in which are supported two vertical slide rods 12 and a centrally disposed piston-and-cylinder arrangement 14. Slidable on the rods 12 is a plate 16 which is secured to a lower end of the piston rod 17 of said arrangement 14. Carried on the plate 16 is an inner form 18 provided with a cartridge heater 20 accommodated therein and a simmerstat 22. The inner form 18 has a shape which is the same as, or generally similar to, that of the backpart mold to be used in the subsequent backpart molding operation.

Also supported on the frame 10 are two sets of depending arms 24 (one only shown in FIG. 1), each set comprising a forward and a rearward arm. An outer band 26 of silicone rubber capable of withstanding temperatures in the order of 225° C. is carried by the two sets of arms, the ends of the band being supported in mountings 28, each mounting being supported in turn between a forward and rearward arm of each set. The inwardly facing surface of each mounting is provided with a proper surface material, e.g. of Tufnol, to prevent the mounting from marking a shoe upper portion if contacted thereby.

The outer band 26 extends upwardly through the bottom of a chamber formed by a back plate 30 secured in the frame 10, a front plate 32 also secured on the frame 10 and a cover extending therebetween, the cover being generally in the shape of an inverted U and comprising two closely spaced apart shaped wall members 34 providing a double-skin effect. The front plate 32 and the inner of the two wall members 34 are made of polished stainless steel and the back plate 30 is of aluminium, thus to provide reflective surfaces for the chamber. Mounted within the chamber, and shaped generally to the shape of the cover, i.e. in the shape of an inverted U, is a radiant heater element 36 of the type generally referred to as a black heater. This heater element 36 is mounted on the back plate 30. The heater serves to heat the air in the chamber, thus to provide an oven arrangement, and radiates heat on to the outer surface of the outer band 26.

The illustrative device further comprises temperature control means for controlling the operation of the heater element 36, said means comprising a temperature sensing element constituted by a thermistor 46 which is accommodated in a pocket constituted by a section 48 of silicone rubber material having a circular tubular cross-section. The section 48 is secured to the outer surface of the outer band 26 by a suitable layer of adhesive 50, in such a manner that a line contact is formed between the section 48 and the surface of the band 26. The longitudinal axis of the section 48 extends perpendicular to the main direction of stretch of the band 26 during operation of the illustrative device. The thermistor 46 has two contact leads 52 which are accommodated each in an insulated sleeve 54, e.g. of polytetrafluroethylene or teflon, and by means of which the thermistor 46 can be connected into a control circuit of the temperature control means.

Said temperature control means also comprises an electronic controller 56 of a conventional commercially available type which, in combination with the thermistor, detects that the control temperature set is close to being achieved and causes the heater which it controls to be switched off intermittently progressively more quickly until the temperature set is in fact achieved, thereby avoiding the relatively wide fluctuations which are a characteristic of a conventional thermostatic control arrangement. The controller 56 is provided with a control knob 58 by means of which a desired control temperature can be set.

The material from which section 48 is made is compatible, from the point of view of heat conductivity, with the material of the outer band 26. For securing the said portion 48 to the outer band 26, any suitable adhesive may be used. The tear strength of the material of the outer band 26 is preferably of the order of 35 KN/meter and its elongation 500%.

The illustrative device also comprises a front guard member 40 having a cut-away portion in its lower edge, said portion being in the shape of an inverted U. The guard member 40 is mounted on the frame 10 for heightwise sliding movement thereon, slots 42 being provided in said member and the member being held on headed bolts 44 accommodated in the slots. The sliding movement is arranged to enable the guard member to be raised to prevent the risk of the operator's hand being trapped thereagainst when the inner form is raised. In addition, to remove the guard member, for access to the heater element 36, each slot 42 has a larger opening at its lower end, through which opening its associated bolt 44 can pass.

What is claimed is:

1. A heater device for heating portions of shoe uppers in a shoe upper backpart molding machine, prior to molding such portions to a desired shape, the device comprising:

a shaped inner form;

a co-operating outer band of a flexible silicone rubber sheet material;

means for effecting relative movement between the inner form and the outer band, whereby a shoe upper placed therebetween can be clamped between the inner form and the outer band, the latter stretching about the inner form to cause the upper to be conformed to the shape thereof and thus causing the shoe upper to be pressed over its area against the inner form;

first and second heating means for heating respectively the inner forms and the outer band, the second heating means comprising radiant heater means to which the outer surface of the band is exposed; and temperature control means for controlling the operation of the second heating means, said temperature control means comprising a temperature sensing element and a controller operable in response to signals from said element to control the second heating means, wherein the temperature sensing element is carried in a tubular pocket of flexible silicone rubber material being secured by adhesive, with a line contact, onto the outer surface of the outer band, with its longitudinal axis of the tubular pocket perpendicular to the direction of stretch of the outer band to insure securement thereto and provide temperature control thereof, even with any stretching of said outer band.

2. A heater device as recited in claim 1 wherein said portion constituting the pocket is of circular cross-section.

3. A heater device as recited in either one of claims 1 or 2 wherein the temperature sensing element is a thermistor.

* * * * *